US007481570B2

(12) United States Patent
Souza et al.

(10) Patent No.: US 7,481,570 B2
(45) **Date of Patent: *Jan. 27, 2009**

(54) NIGHTLIGHT, LED POWER SUPPLY CIRCUIT, AND COMBINATION THEREOF

(75) Inventors: Michael Souza, Fall River, MA (US); Wilson Brunkhurst, North Attleboro, MA (US); John Ferreira, Fall River, MA (US); Anthony Pacitto, North Kingston, RI (US); Jenkin P. Hua, Plainsboro, NJ (US); Joseph Diorio, North Providence, RI (US); Mehmet K. Tanacan, Farmingdale, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 325 days.

This patent is subject to a terminal disclaimer.

(21) Appl. No.: 10/519,782

(22) PCT Filed: Jul. 1, 2003 (Under 37 CFR 1.47)

(86) PCT No.: PCT/US03/20633

§ 371 (c)(1), (2), (4) Date: Feb. 6, 2006

(87) PCT Pub. No.: WO2004/005795

PCT Pub. Date: Jan. 15, 2004

(65) Prior Publication Data

US 2007/0002570 A1 Jan. 4, 2007

Related U.S. Application Data

(63) Continuation-in-part of application No. 10/188,533, filed on Jul. 2, 2002, now Pat. No. 6,824,296.

(51) Int. Cl.
*F21V 1/10* (2006.01)

(52) U.S. Cl. ..... 362/642; 362/644; 362/646; 362/282; 362/319; 362/322

(58) Field of Classification Search ..... 362/641, 362/642, 644, 646, 282, 319, 322, 250; D26/26; 315/187, 185 S, 231, 283
See application file for complete search history.

(56) References Cited

U.S. PATENT DOCUMENTS

| | | | | |
|---|---|---|---|---|
| 3,795,830 | A * | 3/1974 | Richardson | 315/135 |
| 3,968,355 | A * | 7/1976 | Smallegan | 362/642 |
| 5,155,669 | A * | 10/1992 | Yamuro | 362/252 |
| 5,388,357 | A * | 2/1995 | Malita | 40/570 |
| 5,463,280 | A * | 10/1995 | Johnson | 315/187 |
| 5,575,459 | A * | 11/1996 | Anderson | 362/250 |
| 5,655,830 | A * | 8/1997 | Ruskouski | 362/240 |
| 5,688,042 | A * | 11/1997 | Madadi et al. | 362/240 |
| 6,709,126 | B1 * | 3/2004 | Leen | 365/95 |
| 6,824,296 | B2 * | 11/2004 | Souza et al. | 362/282 |
| 2002/0030991 | A1 * | 3/2002 | Victor | 362/226 |
| 2004/0095763 | A1 * | 5/2004 | Guerrieri et al. | 362/240 |
| 2004/0246704 | A1 * | 12/2004 | Burdick | 362/95 |

* cited by examiner

*Primary Examiner*—Ismael Negron
(74) *Attorney, Agent, or Firm*—Carter, DeLuca, Farrell & Schmidt, LLP

(57) ABSTRACT

The present invention pertains to a night light assembly which plugs directly into an electrical wall receptacle to provide a beam of light that can be directed along different paths.

13 Claims, 7 Drawing Sheets

NIGHTLIGHT, LED POWER SUPPLY CIRCUIT, AND COMBINATION THEREOF

This application, which is the U.S. national stage of international application PCT/US2003/020633 designating the United States and filed Jul. 1, 2003, is a continuation-in-part of prior U.S. application Ser. No. 10/188,533 filed Jul. 2, 2002 (now U.S. Pat. No. 6,824,296 issued Nov. 30, 2004).

BACKGROUND OF THE INVENTION

1. Field of the Invention

The present invention relates generally to lights that are used to provide low level illumination in a room or passageway during the night, and more particularly to a night light assembly which provides a focused bean of light from an incandescent bulb or an LED that can be easily and selectively oriented from a rotatable assembly to shine in different directions and to an improved power supply circuit for an LED.

2. Description of the Related Art

Night lights which can be plugged into wall receptacles are normally used to provide low level illumination in a dark room or hallway. When used in a bedroom, a night light can provide sufficient light to allow a person, upon waking, to move about the room without banging into furniture, a doorway or such and still provide an ideal environment for sleeping. Where the bedroom is a child's nursery, a minimum amount of light in usually desirable. Very young children are often fearful of complete darkness and, in addition, should a parent wish to check on the sleeping child without turning on the room light, a low intensity night light that is continuously on is most useful and desirable.

The conventional night light consists of an electrical assembly having an electrical socket integrated with a plug for insertion into a wall receptacle. A low wattage lamp is held in the socket and a small translucent shade is usually provided to shield the lamp from direct view. A night light of this type normally uses a low wattage incandescent lamp which provide low level illumination. Light from the shielded bulb is normally reflected off an adjacent wall surface into the room to provide localized illumination that is purely utilitarian in function. The light is neither focused nor directionally controllable.

The patent to Victor, U.S. Pat. No. 6,200,001 illustrates a night light assembly which allows light from a small wattage lamp within the fixture to pass through a lens into the room. The beam of light emitted from the assembly can be directed by grasping and rotating a member containing a lens.

In the foregoing patent, the night light assembly has a stationary lamp which is positioned traverse to the rotational axis of the rotatable lens and, therefore, the filament of the lamp is not centered with the lens. With this arrangement, the base of the lamp interferers with and blocks reflected light from passing through the lens. In addition, the stationary lamp is hard wired to a PCB board that in turn is mechanically fastened to the prongs of the plug which not only increases the cost of manufacture of the assembly, but prevents the bulb from rotating with the head member.

A rotatable night light assembly that can direct a focused beam of light in different directions from a lamp aligned along the rotational axis of the lens to provide increased illumination, that is of a simple design and can be manufactured and sold at a relatively low cost is clearly desirable.

LED's are becoming more popular in residential and commercial lighting. Recently LED's have been used in night lights. As LED's operate at low DC voltage and low current, the power supply circuit for an LED typically uses resistor current limiting circuitry. The use of a resistor in the power supply circuit has the disadvantage of generating heat and not being the most efficient. What is needed is a power supply circuit for an LED that produces less heat and is more efficient.

SUMMARY OF THE INVENTION

In one embodiment, the present invention pertains to a night light assembly which plugs directly into an electrical wall receptacle to provide a beam of light that can be directed along different paths. The assembly comprises a housing having a plug with projecting blade contacts for insertion into a wall receptacle and a light sensor for automatically controlling the activation and de-activation of the lamp of the nightlight. A cover member rotatably supported by the housing includes a lens, a low wattage lamp, a support member, and a lamp retaining member.

The low wattage lamp in the cover assembly is coupled, via sliding contacts, to the blade contacts in the base housing. This arrangement allows the cover and the lamp to be rotated as a unit relative to the base housing without limitation. The lamp retaining member is non-rotatably coupled to the cover and is rotatably engaged by a retaining member fixed to the housing member. The longitudinal axis of the low wattage lamp located in the lamp retaining member is aligned along the rotational axis of the lens in the cover to permit both direct and reflected light to pass through the lens in the cover without being obstructed b the base of the lamp. The disclosed assemblage is a new improved nightlight of simple design which provides increased light and can be manufactured and sold at relatively low cost.

The low wattage lamp used in the nightlight can be either an incandescent bulb or a light emitting diode (LED) such as an ultrabright white LED either as a single bulb or a cluster of 2 or more bulbs. A photo sensitive circuit can be provided to automatically energize the incandescent bulb or the LED during low light conditions. When an LED is use as the light source, the LED is energized by a new improved power supply that is both simple in design and more efficient in operation than the standard power supply circuit used for LED's.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed concept and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which:

DETAILED DESCRIPTION

Figure 1:
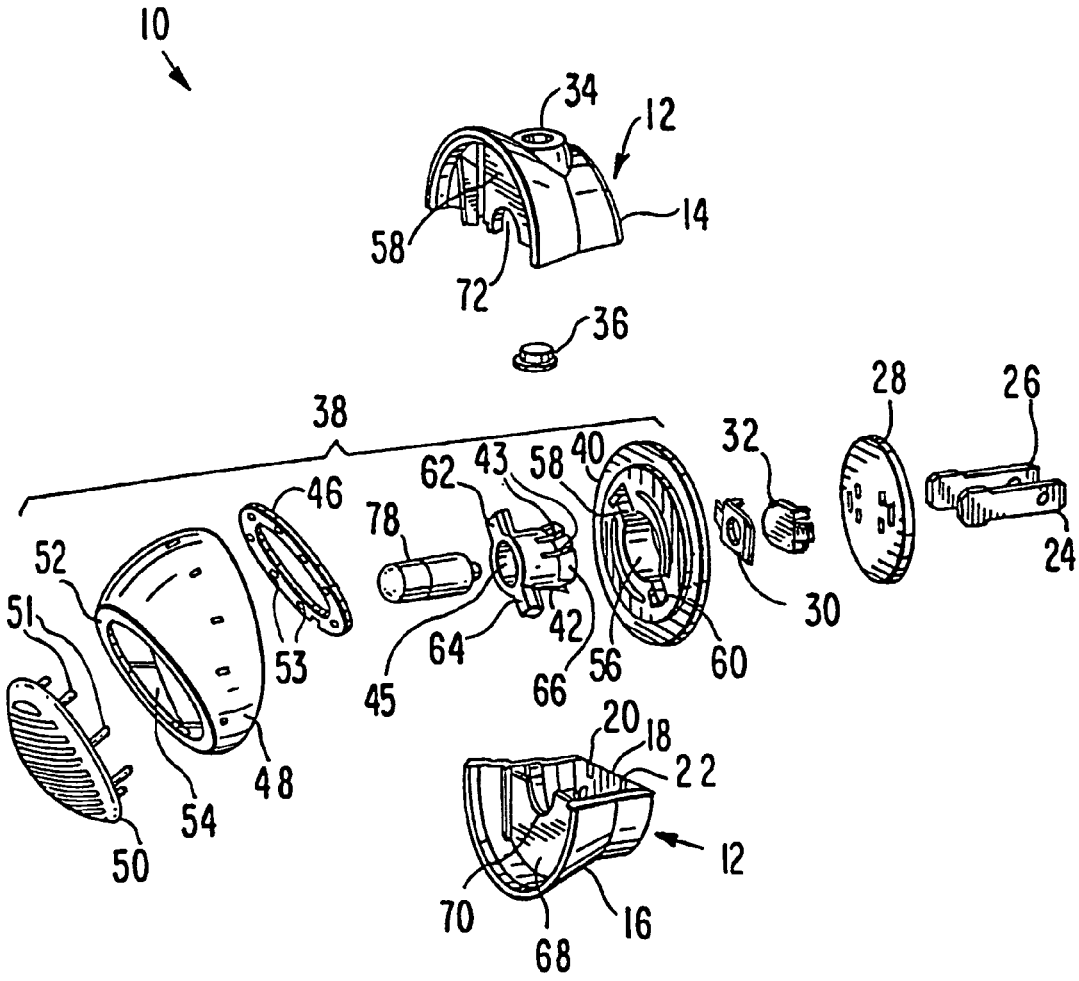
FIG. 1 is an exploded view of the embodiment of the invention.
Figure 4:
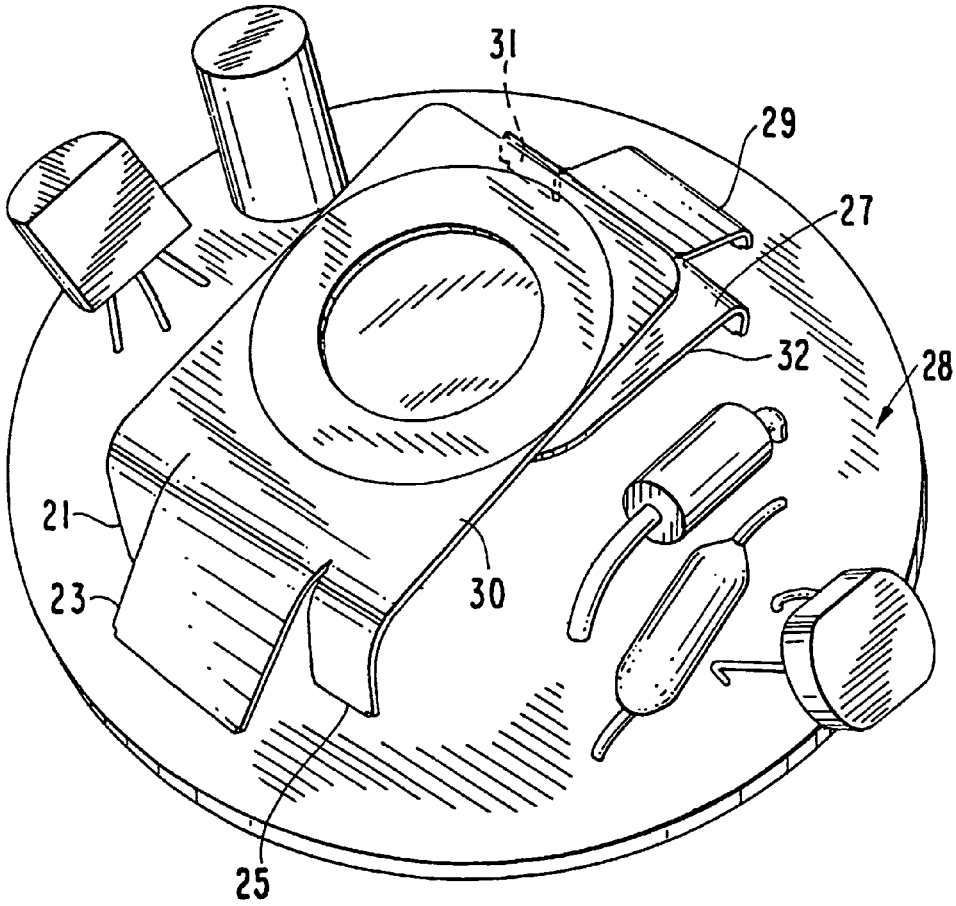
FIG. 4 is a view of the top of a PCB having lamp contacts and a photo sensitive control circuit for controlling a low wattage incandescent bulb.

Referring to FIG. 1, there is disclosed an exploded view of an embodiment of a night light in accordance with the principles of the invention, generally designated by numeral 10. The assembly 10 is adapted to be plugged into a wall receptacle located in a bedroom, a nursery or any other room or passageway in which the use of a night light is needed to provide low level illumination for safety, convenience or for any other reason. The assembly includes a base member 12 and a cover member 38. The base member consists of a first section 14 and a mating second section 16. The base member 12 is made up of sections 14 and 16 each of which includes a rear wall 18 having two openings 20, 22 for receiving blade contact 24 and blade contact 26. While the blades 24 and 25 are shown in FIG. 1 as not being polarized, it is to be understood that in those instances where polarized blades are required by local code requirements, blade 24 can be the hot blade contact and blade 26, which can be of slightly greater width, can be the neutral blade contact. A Printed Circuit Board (PCB) assembly 28 is mechanically connected to the rear ends of the blade contacts 24, 26 and the side edge of the PCB board is positioned against a step 29 on the inside surface of sections 14 and 16 of the base member 12 to lock the PCB 28 and the blades to the base member 12. A neutral contact 32 for the lamp 78 is mechanically and electrically connected to the PCB board with three contacts 21, 23 and 25; and a neutral or side contact 32 for the lamp 78 is mechanically and electrically connected to the PCB assembly 28 with three contacts 27, 29 and 31 (see FIG. 4). The hot contact 32 is provided to make mechanical and electrical contact with the center base contact of a low wattage lamp and neutral contact 30 makes mechanical and electrical contact with the side base contact of the low wattage lamp. The first section 14 of base member 12 supports an opening 34 sized to accept and retain a light sensor lens 36 below which is a light sensor (not illustrated) electrically connected to the PCB assembly 28 to automatically control the flow of current to the low wattage lamp during low level light conditions. Referring to FIG. 4, there is shown a PCB with a photo cell connected to a standard circuit for energizing an incandescent bulb during low light conditions. As the circuit for controlling the lighting of the incandescent bulb and its mode of operation is known to those skilled in the art, neither the circuit configuration nor its operation will be described. The shape of bulb contacts 30, 32 shown are representative of a socket for receiving a bulb and can vary in design and configuration to accept a bulb having a candelabra base, a medium base, or a one or two piece holder for an LED etc. In operation, the light sensor or photo cell allows the lamp to be energized when the ambient light is below a predetermined level, and disconnects the lamp from the current source when the ambient light is above that level.

The cover member 38 consists of an internal support member 40 which provides support for a lamp support member 42 adapted to receive a low wattage lamp 78, a lens retaining ring 46, a cover 48 and a lens 50. The cover member is a unitary assemblage which is rotatably coupled to base member 12.

Referring to the cover member 38, lens 50 supports projecting fingers 51 positioned around its periphery aligned to pass through the opening 54 located in a flange 52 of cover 48. The flange 52 defines the same opening 54 located in cover member 38 for passing light. A lens retaining ring 46 has openings 53 located to receive the projecting fingers 51 of the lens 50 to hold the lens 50 securely against the flange 52 of the cover 48.

Support member 40, which can be light in color to function as a reflecting body for light from the low wattage lamp, has an outside diameter sized to fit within an annular recess located within the rear end of cover 48. Support member 40 supports a centrally located opening 56 and opposing arm capturing and retaining recesses 58, 60 for capturing and holding the lamp support member 42. Latch members 76 located at each end of each recess 58, 60 is provided to engage arms 62, 64 of the lamp support member 42 to hold lamp support member 42 captive to support member 40, see FIGS. 2 and 3.

The lamp support member 42 has, at a first end, two outwardly projecting arms 62, 64 designed to be received by recesses 58, 60 and held within the recesses by latch members 76 located at the end of each recess. The other or second end 66 of lamp support member is flared outward and contains slots 43 to allow the flared end to flex inwardly. A centrally located opening 45 in lamp support member 42 defines a socket for receiving the low wattage lamp 78. Lamp 78 can be inserted into the centrally located socket of the lamp support member 42 from the first end, and projecting pins of the lamp engage channels in the socket to lock the lamp in position in those instances where the lamp has a bayonet base.

During assembly, the projecting fingers 51 are passed through the opening 54 in cover 48 and extend through corresponding openings 53 of lens retaining ring 46 and is secured by, for example, ultrasonic welding, adhesive or the like, to lock the lens to the cover.

The flared end 66 of the lamp support member 42 is passed through the opening 56 in the support member 40 and held captive by outwardly projecting arms 62, 64 which are received by recesses 58, 60 and held in position by the latch members 76.

A low wattage lamp 78 is now positioned within the socket in the lamp support member 42. After the lamp support member 42 and the lamp 78 are inserted within and connected to the support member, the support member 40 is secured to the cover 48 by, for example, ultrasonic welding, adhesive or the like.

The printed circuit board 28 is connected to the rear ends of blades 24, 26 and supports electrical components thereon (see FIG. 4) required to enable a light sensor located behind light sensor lens 36 to control the on-off operation of the lamp 78 in response to ambient light. The ends of blade contact 24 and blade contact 26 project through the PCB and are electrically connected to the components on the board via electrical conducting trace paths on the board. As noted previously, the PCB shown in FIG. 4 is of known design for supplying current to an incandescent bulb when the ambient light is below a predetermined level. The light sensor is positioned behind lens 36 which in turn is housed in opening 34 in the first section 14 of base member 12. The sub-assemblies of the cover member 38 and the first 14 and second 16 sections of the base member 12 are now ready to be joined together to form the night light.

The PCB including blade contacts 24, 26 is placed into base member 16 with both blade contacts 24, 26 being located within slot openings 22 and 20 respectively. The flared second end 66 of the lamp support member 42 is positioned within cutout 70 of retaining wall 68 of the second section 16 of base member 12. The cutout 70 of the second section 16 is located between the back face of support member 40 and the start of the flared section at the second end of the lamp support member 42. The top section 14 is now positioned on top of the bottom section 16, care being taken to insure that cutout 70 of retaining wall 68 of the top section is positioned between the back face of the support member 40 and the start of the flared section of the second end 66 of the lamp support member 42. The two sections 14, 16 can be joined together by ultrasonic welding, an adhesive or the like. It is to be noted that by positioning the lamp support member 42 within the openings 70, 72 of the first and second sections of the base member 12, the cover member 38 is rotatably coupled to base member 12 and the contacts of the lamp make electrical contact with the bulb contacts 30, 32. Thus, cover member 38, including the lamp, rotate together as a unitary unit, and can be rotated without limitation in either direction to allow a user to controllably direct a beam of light from a night light.

The bulb for the night light can be an incandescent bulb or an LED. LED's available today have certain advantages such as being light in weight, are available in different colors such as green, white, red, blue and amber, operate with low power levels, have a relatively long life and are available with various base contacts. LED's are finding use in residential and commercial applications. One recent use of LED's is in flashlights and night lights. As noted above, the bulb used in the night light described above can be either an incandescent lamp or an LED. In those instances where the bulb of the night light is an LED, there is here disclosed a new higher efficiency power supply of simple design which can be located on the PCB 28.

The prior art power supply for an LED, which operate at low DC voltage and low current normally uses a resistor as the current limiting component. A disadvantage of using a resistor to limit the current is the generation of heat and loss of efficiency. The new improved LED power supply circuit here disclosed uses an energy storage component such as a capacitor or an inductor in combination with a resistor to provide power from the line to light the LED. With a resistor-capacitor (R-C) or resistor- inductor (R-L) network in series in the power line, the LED night light operates at a higher efficiency and generates less heat than the prior art LED power supply circuit which has only a resistor as a current limiting component.

Figure 5:
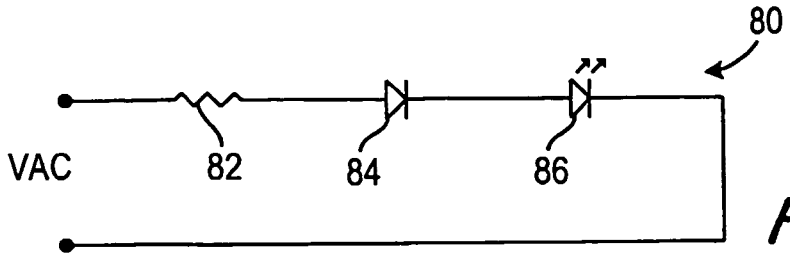
FIG. 5 is a schematic of a standard power supply circuit for an LED.

Referring to FIG. 5 there is shown a schematic circuit of a prior art power supply circuit 80 for an LED. Circuit 80 consists of a resistor 82, a diode 84, and an LED 86, all in a series circuit arrangement. The purpose of the resistor is to limit the current in the circuit so that the LED 86 is not overloaded. The diode 84 blocks the AC current when its polarity is such that the LED is reversed biased. The diode is needed to block a high reverse voltage which cannot be done by the LED. Thus, the resistor 82 limits the forward biased current and the diode 84 blocks the reverse biased current.

Figure 6:
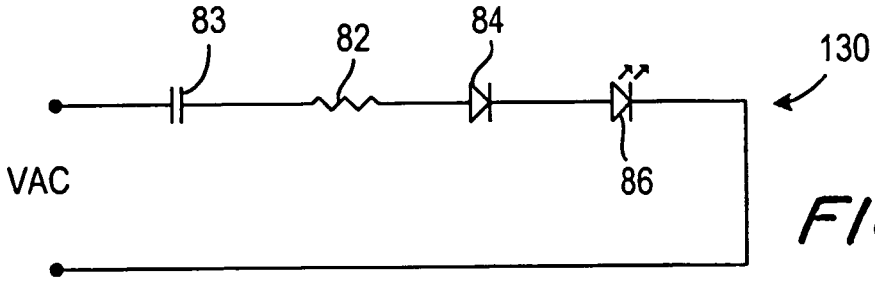
FIG. 6 is a schematic of a power supply circuit for an LED in accordance with the principles of the invention.

Referring to FIG. 6, there is shown a schematic of a power supply circuit 130 for an LED in accordance with the principles of the invention. The circuit of FIG. 6 is similar to circuit 80 with the addition of capacitor 83 in the series circuit. Thus, all the components of FIG. 6 have the same reference numerals as the corresponding components of FIG. 5 except for capacitor 83. The capacitor 83 helps to limit the current to the LED. Because the capacitor has impedance that helps to limit the current in the circuit, the value of resistor 82 can be reduced without causing an increase in the circuit current. The reduction of the resistor value results in less power being dissipated in the resistor and, therefore, results in a circuit that is more efficient.

Figure 2:
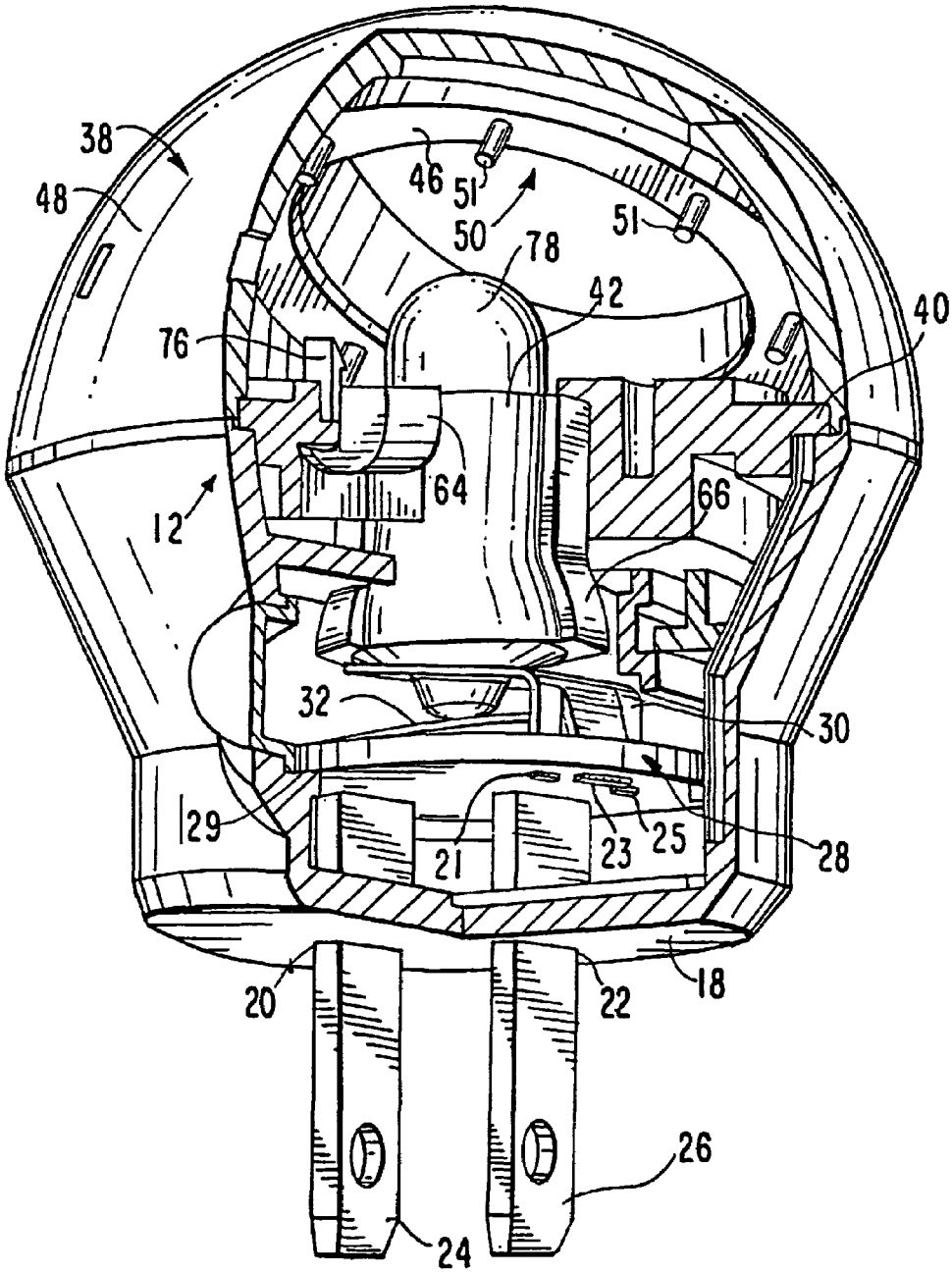
FIG. 2 is a partial cut away perspective view of an embodiment of the invention illustrating the relationship of the various components relative to each other.
Figure 3:
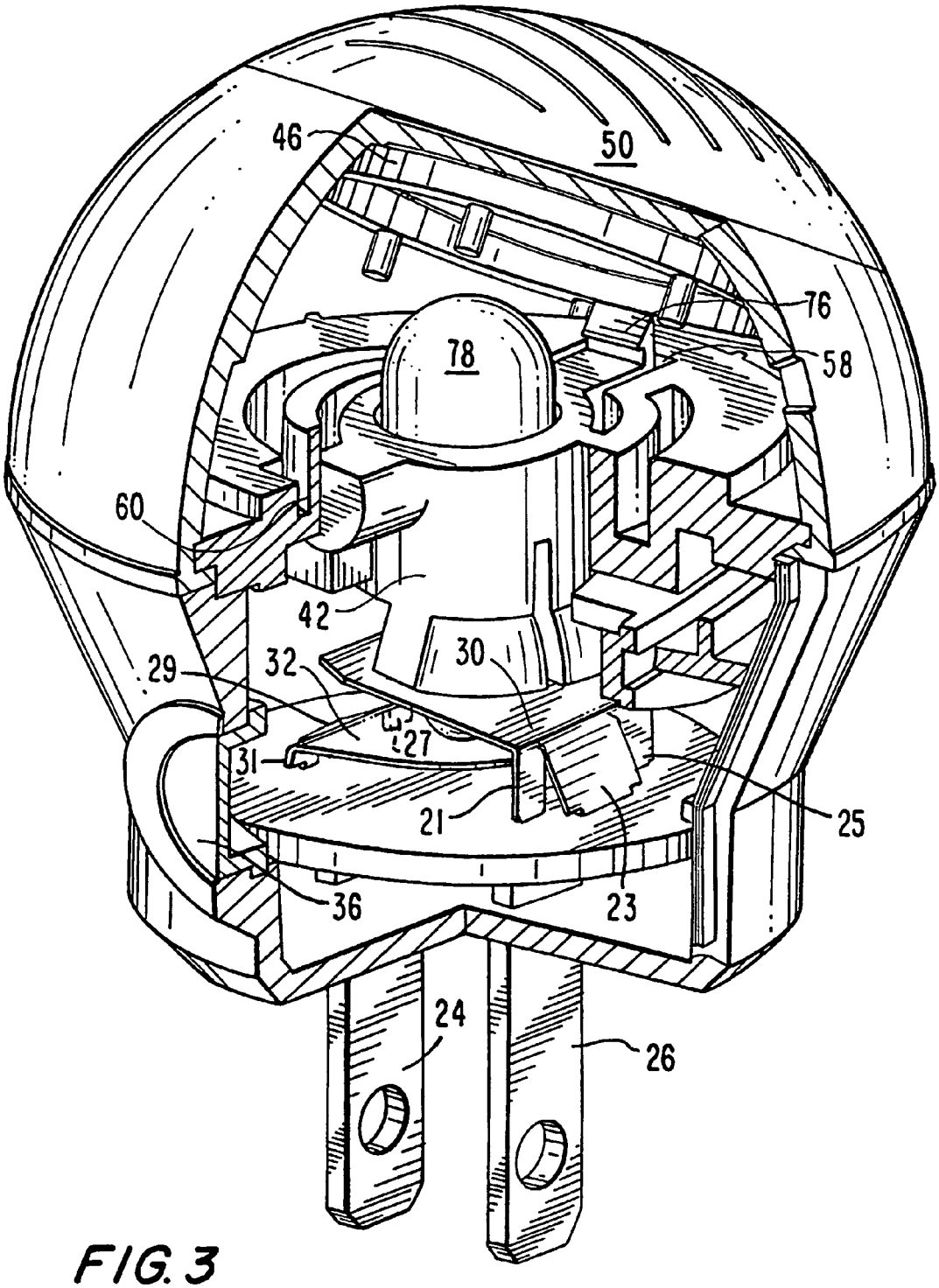
FIG. 3 is another partial cut away perspective view of the embodiment of the invention illustrating the relationship of the various components relative to each other.
Figure 7:
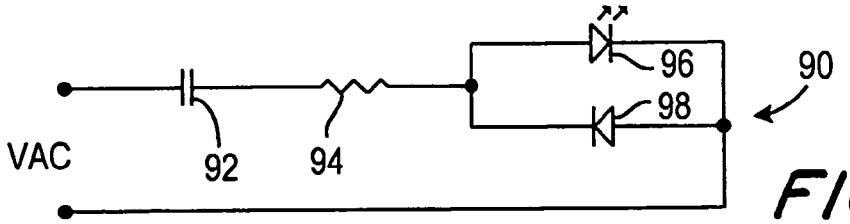
FIG. 7 is a schematic of another power supply circuit for an LED in accordance with the principles of the invention.

Referring to FIG. 7, there is shown a schematic of a power supply circuit 90 for an LED in accordance with the principles of the invention. Circuit 90 differs from circuit 80 in that it includes a parallel circuit of a diode 98 in parallel with the LED 96 and in reverse polarity with respect to the LED, and the parallel circuit is in series with a capacitor 92. By adding the capacitor to the circuit, the value of the resistor can be decreased because the capacitor adds some impedance to the circuit. Thus, because the value of the resistor is reduced, less power is dissipated across the resistor and, therefore, the circuit is more efficient. Because the value of the resistor is reduced, the heat generated by the resistor is less. By placing the diode 98 in parallel with and in opposite polarity to that of the LED 96, the current which flows through the LED is redirected through the diode when the AC signal reverse biases the LED. Thus, the diode is an alternate route for the current to travel as opposed to it being blocked. The circuit 90 of FIG. 2 is adapted to be connected to a source of AC potential.

Figure 8:
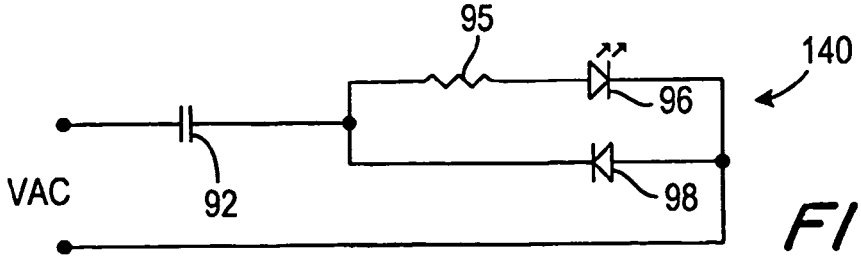
FIG. 8 is a schematic of a variation of the power supply circuit of FIG. 7 for an LED in accordance with the principles of the invention.

Referring to FIG. 8, there is shown a schematic of a power supply circuit 140 for an LED which is a variation of the power supply circuit of FIG. 7. All of the components of FIG. 8 have the same reference numerals as the corresponding components of FIG. 7 except for resistor 94 of FIG. 7 which is relocated to be in series with LED 96 and is now identified as resistor 95 in FIG. 8. In the circuit of FIG. 8, the impedance of capacitor 92 and that of resistor 95 combine to limit the inrush of current.

Figure 9:
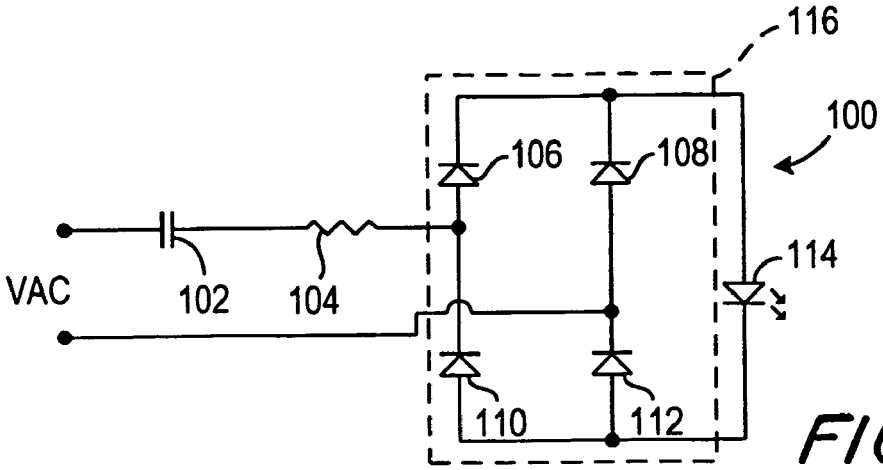
FIG. 9 is a schematic of still another power supply circuit for an LED in accordance with the principles of the invention.

Referring to FIG. 9, there is shown a schematic of another power supply circuit 100 for an LED in accordance with the principles of the invention. In the circuit of FIG. 9, a first input terminal of a bridge rectifier 116 is connected through a resistor 104 in series with a capacitor 102 to a first terminal adapted to be coupled to a source of AC voltage. The second input terminal of the bridge rectifier 116 is connected directly to a second terminal adapted to be coupled to the source of AC voltage. The bridge rectifier is comprised of diodes 106, 108, 110 and 112 connected in a bridge configuration having two input terminals and two output terminals. The two output terminals of the bridge rectifier 116 are connected across an LED 114. In this circuit capacitor 102 is in series with resistor 104. As with circuit 90 of FIG. 7, the benefits of a resistor having a reduced value because of the presence of the capacitor are reduced heat from the resistor, less loss by using a resistor of reduced value and, therefore, a higher operating efficiency. In addition, as the AC signal to the LED is fully rectified ( the negative half cycle is flipped to the positive side of zero voltage), the LED 114 is energized during the whole AC cycle. Thus, the current that is bypassed through the diode is used to light the LED.

Figure 10:
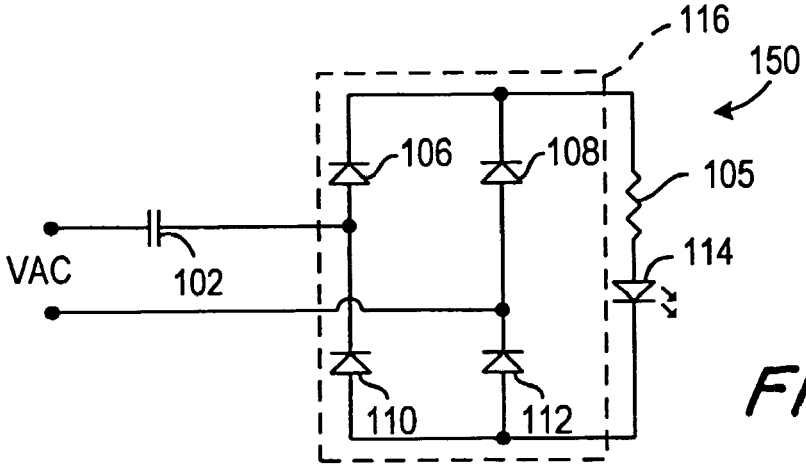
FIG. 10 is a schematic of a variation of the power supply circuit of FIG. 9 for an LED in accordance with the principles of the invention.

Referring to FIG. 10, there is shown a schematic of a power supply circuit 150 for an LED which is a variation of the power supply circuit 100 of FIG. 9. All of the components of the circuit of FIG. 10 have the same reference numerals as the corresponding components of FIG. 9 except for resistor 104 of FIG. 9 which is relocated to be in series with LED 114 and is now identified in FIG. 10 as resistor 105. Resistor 105 in combination with the capacitor limits the inrush of current to the LED.

Figure 11:
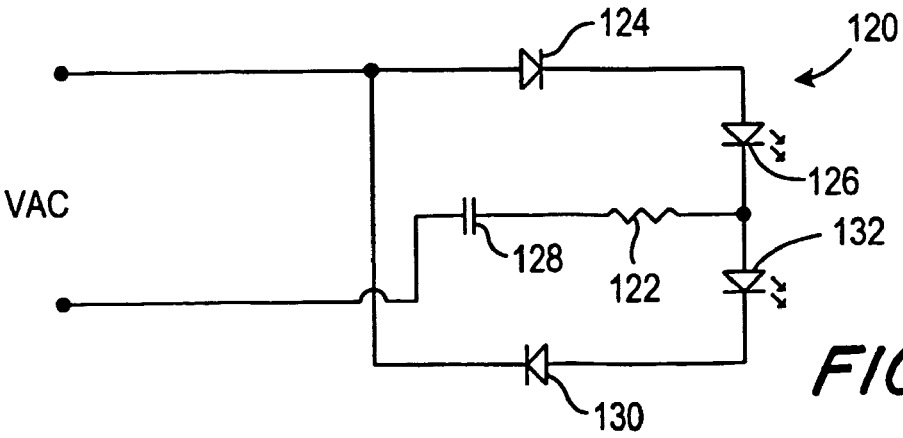
FIG. 11 is a schematic of a further power supply circuit for an LED in accordance with the principles of the invention.

Referring to FIG. 11, there is shown a schematic of still another power supply circuit 120 for an LED in accordance with the principles of the invention. In the circuit of FIG. 11, resistor 122, diode 124, LED 126 and capacitor 128 are all connected in series and adapted to be connected to a source of AC voltage. The resistor 122 and diode 124 block negative half waves. A second diode 130 is series with a second LED 132 are connected in parallel with the diode 124 and LED 126, but in reverse polarity. With this circuit each LED 126, 132 is energized alternately by each half cycle of the AC wave. The capacitor 128 in series with the resistor 122 provides the same advantages noted previously where, because of the presence of the capacitor, the resistor has a reduced value which results in reduced heat from the resistor and higher operating efficiency.

In each power supply circuit shown, it is understood that an inductor can be substituted for the capacitor.

Figure 12:
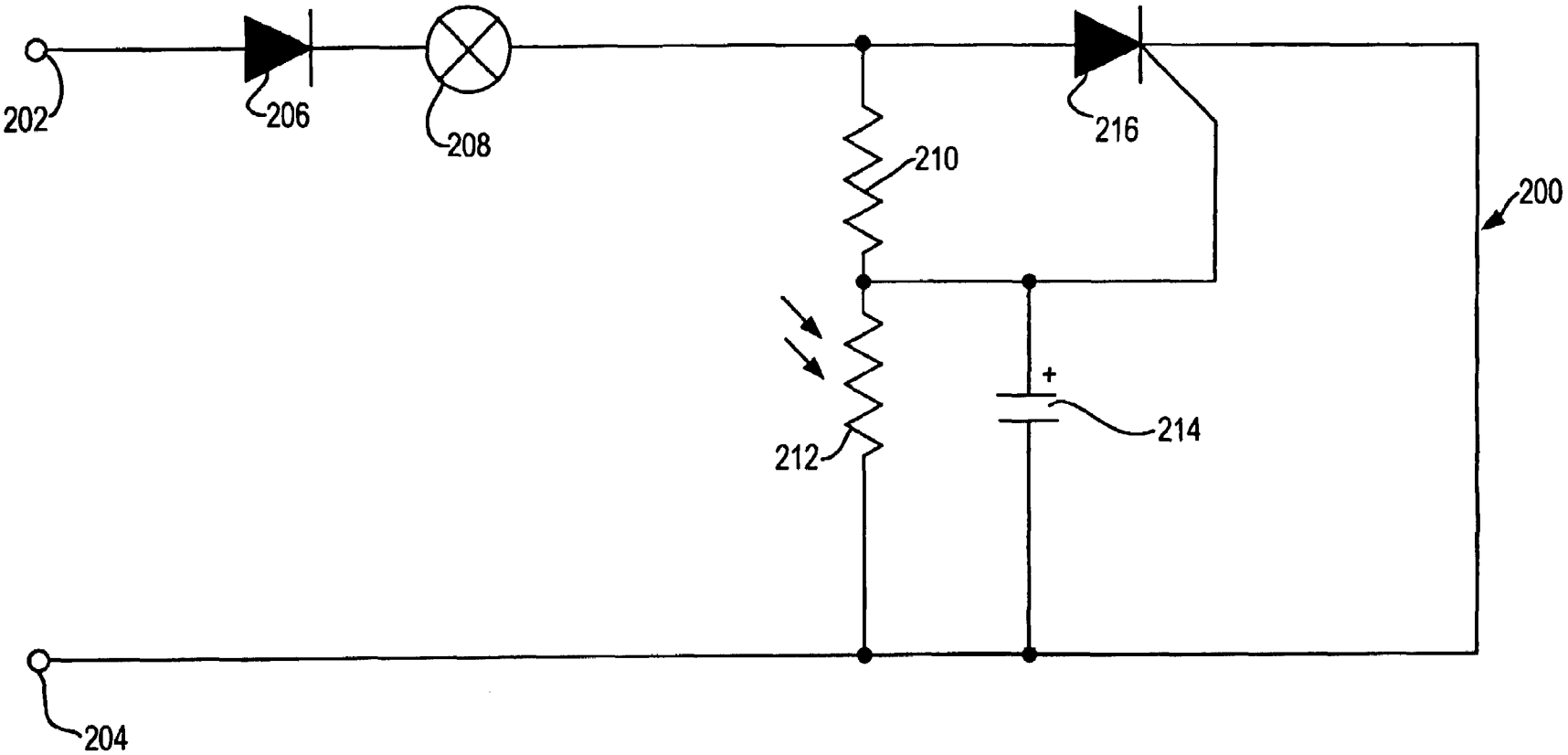
FIG. 12 is a schematic of a power supply having a photo sensitive device for controlling a low wattage incandescent bulb for use in the night light.

Referring to FIG. 12 there is shown a power supply 200 having a photo sensitive device for an incandescent bulb for use in the night light disclosed. The input terminals 202, 204 of the power supply are connected to a source of power such as 120 V, 60 HZ. Input terminal 202 is connected through a diode 206 such as a IN4004 to an incandescent bulb 208 which can have a rating of 2 W at 60 V. A series circuit of a resistor 210 which can have a value of 2.4 M ohms and a photo sensitive device 212 such as a CDS are connected between the bulb and input terminal 204. Thus, diode 206, light bulb 208, resistor 210 and CDS 212 are connected in series across the input terminals 202, 204. A capacitor 214 having a value of 1 UF at 50V is connected in parallel with the CDS 212. The anode terminal of a gated semiconductor device 216, which can be an MCR100-6 is connected to the junction of the bulb 208 and resistor 210, the gate terminal of device 216 is connected to the junction of the CDS 212 and capacitor 214, and the cathode terminal of device 216 is connected to terminal 204.

While there has been described herein the principles of the invention, it is to be clearly understood to those skilled in the art that this description is made only by way of example and not as a limitation to the scope of the invention. Accordingly, it is intended, by the appended claims, to cover all modifications of the invention which fall within the true spirit and scope of the invention.

What is claimed is:

1. A night light comprising:

a base having blade contacts for insertion into an electrical receptacle;

a cover member having a lens affixed thereto;

a lamp support member for receiving an LED for emitting light through the lens, the lamp support member being non-rotatably coupled to the cover member at a first end and rotatably coupled to the base member at a second end; and, a light sensor coupled to the base member to control activation of the lamp in response to the ambient light level.

2. The night light of claim 1 further comprising a power supply circuit for the LED comprising:

a resistor, a diode, an LED, and a capacitor, all connected in series and adapted to be connected to a source of AC potential wherein the value of the current in the series circuit is determined by the value of the impedance of the resistor in series with the capacitors.

3. A night light comprising:

a base member having blade contacts for insertion into an electrical receptacle;

a first electrical contact coupled to a first blade contact and a second electrical contact coupled to a second blade contact wherein the first and second contacts are slidably coupled to base contacts of the lamp via a PCB board;

a cover member having a lens affixed thereto;

a lamp support member for receiving an LED for emitting light through the lens, the lamp support member supports outwardly projecting protrusions adapted to be held captive by a support member of the cover member having an opening for receiving the LED and being non-rotatably coupled to the cover member at a first end and rotatably coupled to the base member at a second end;

the base having a first section and a second section which connect together, wherein the first section has a first portion of a retaining wall and a first section of an opening, and the second section has a second portion of the retaining wall and a second section of the opening wherein the first and second sections of the opening support the second end of the lamp support member;

a light sensor coupled to the base member to control activation of the LED in response to the ambient light level; and a power supply circuit coupled to the LED comprising:

a resistor;

a diode; and a capacitor, all connected in series and adapted to be connected to a source of AC potential wherein the value of the current in the series circuit is determined by the value of the impedance of the resistor in series with the capacitor.

4. The night light of claim 3 wherein the second end of the lamp support member is funnel shaped.

5. The night light of claim 4 wherein the first and second sections of the opening fit around and are rotatably coupled to the second end of the lamp support member.

6. The night light of claim 3 further comprising:

a support member located within the cover member having a centrally located opening and recesses for receiving and holding captive the lamp support member.

7. The night light of claim 6 wherein the recesses support latch members engage and retain the first end of the lamp support member captive to the support member.

8. The night light of claim 7 wherein the first end of the lamp support member supports arms which fit within the recesses in the support member and are retained in place by the latch members.

9. The night light of claim 8 wherein the second end of the lamp support member supports a radially extending protrusion which rotatably engage a retaining wall of the base member.

10. The night light of claim 9 wherein the retaining wall of the base member rotatably engages the second end of the lamp support member between the radially extending protrusion and the support member of the cover member.

11. The night light of claim 10 wherein the radially extending protrusion at the second end of the lamp support member is an outwardly extending flange.

12. The night light of claim 10 wherein the radially extending protrusion at the second end of the lamp support member is funnel shaped.

13. The night light of claim 12 wherein the small diameter of the funnel shaped end of the lamp support member is coupled to the second end of the lamp support member.

* * * * *